US005635297A

United States Patent [19]

Ogawa et al.

[11] Patent Number: 5,635,297

[45] Date of Patent: Jun. 3, 1997

[54] INK JET RECORDING SHEET

[75] Inventors: Susumu Ogawa; Hideaki Senoh; Kouji Idei, all of Tokyo, Japan

[73] Assignee: Mitsubishi Paper Mills Limited, Tokyo, Japan

[21] Appl. No.: 486,290

[22] Filed: Jun. 7, 1995

Related U.S. Application Data

[63] Continuation of Ser. No. 160,155, Dec. 2, 1993, abandoned.

[30] Foreign Application Priority Data

Dec. 10, 1992 [JP] Japan ..... 4-330132
Dec. 10, 1992 [JP] Japan ..... 4-330133

[51] Int. Cl.[6] ..... B41M 5/00

[52] U.S. Cl. ..... 428/342; 428/211; 428/514; 428/520; 428/535; 428/537.5

[58] Field of Search ..... 428/195, 537.5, 428/211, 913, 914, 520, 534, 535, 342, 514; 427/146

[56] References Cited

U.S. PATENT DOCUMENTS 4,944,988 7/1990 Yasuda et al. ..... 428/195

FOREIGN PATENT DOCUMENTS 495591 7/1992 European Pat. Off. .
52-9074 1/1977 Japan .
55-51583 4/1980 Japan .
55-144172 11/1980 Japan .
56-157 1/1981 Japan .
58-72495 4/1983 Japan .
61-235184 10/1986 Japan .
62-282967 12/1987 Japan .
4-298380 10/1992 Japan .
4298380 10/1992 Japan ..... 428/537.5

OTHER PUBLICATIONS

Derwent Abstract of JP 4–119881 (Apr. 21, 1992).

*Primary Examiner*—Pamela R. Schwartz
*Attorney, Agent, or Firm*—Armstrong, Westerman, Hattori, McLeland & Naughton

[57] ABSTRACT

An ink jet recording sheet which includes a support including a wood pulp and a pigment, an ink-receiving layer provided on one side of the support and a backcoat layer provided on the other side of the support, wherein the backcoat layer contains a binder containing a synthetic polymer having a glass transition temperature of −50° to +25° C. and at least one water-soluble binder selected from a starch, a polyvinyl alcohol and a cellulose derivative. The ink jet recording sheet is less in undulation caused by absorption of ink after ink jet recording and has a curling resistance hardly susceptible to change in temperature and humidity.

9 Claims, 1 Drawing Sheet

INK JET RECORDING SHEET

This application is a continuation of application Ser. No. 08/160,155 filed Dec. 2, 1993, now abandoned.

BACKGROUND OF THE INVENTION

The present invention relates to an ink jet recording sheet with which recording is performed using ink and in particular, to an ink jet recording sheet which is inhibited from occurrence of undulation of the sheet caused by absorption of ink after recording and which is assured in curling resistance hardly susceptible to change in temperature or humidity.

The ink jet recording method performs recording of graphics and characters by allowing ink droplets ejected by various working principles to deposit on a recording sheet such as a paper. The ink jet recording has such favorable features that it makes high-speed recording possible, that it produces little noise, that it can easily perform multi-color recording, that there is no limitation as to kind of patterns or images, and that it requires no processing for development and fixing. Thus, the ink jet recording is rapidly becoming widespread in various fields as devices for recording various figures including kanjis (Chinese characters) and color images. Furthermore, the images formed by the multi-color ink jet recording method are not inferior to those printed by multi-color press or those obtained by color-photography. Besides, use of the ink jet recording extends to a field of full-color image recording where number of copies is not so many, since costs per copy are less than those employing the photographic process.

As for the recording sheets used for this ink jet recording, efforts have been made from the aspects of printer hardwares or ink compositions in order to use woodfree papers or coated papers used for ordinary printing or writing. However, improvements in recording sheets have come to be required increasingly in order to go side by side with developments in printer hardwares such as ever increasing speed, development of ever finer definition images of full color, and also with expanding fields of uses. That is, recording sheets are demanded to develop ever high image reproducibility, and in order to meet that demanded image be maintained high, and hue characteristics be bright and appealing, the ink applied be fixed quickly and does not bleed or spread even though a different ink is put over additionally. Moreover, ink should set quickly, dots should not spread more than needed and the circumference of dots be sharp and demarcating.

Various proposals have been made for such demand. For example, an ink-receiving layer mainly composed of silica pigments which forms a void layer is provided on the surface of a support to improve ink-absorbing property (Japanese Patent Application Kokai Nos 52-9074 and 58-72495). In order to improve ink absorption property by providing this ink-receiving layer to obtain a high printed dot density and printed dots free from spread of ink dots, Japanese Patent Application Kokai Nos. 55-51583 and 556-157 propose to add non-colloidal silica powders to the ink-receiving layer. Furthermore, noticing that color quality and clearness depend on the state of the distribution of the dye of the ink in the ink-receiving layer, it has been proposed to use a specific agent which adsorbs the dye component (Japanese Patent Application Kokai No. 55-144172).

Further, as another problem encountered after performing the ink jet recording, there is the occurrence of undulation of the sheet after printing with aqueous ink. If the recording sheet after printing has undulation, beautifulness of appearance which is organ-oleptically evaluated is deteriorated although the sheet is excellent in image reproducibility. The undulation is an irregularity generated due to expansion and contraction of wood pulp in the support caused by the permeated ink. Accordingly, to inhibit permeation of the ink into the support is a measure for avoiding occurrence of undulation. This is the same means as allowing the ink-receiving layer to absorb a large amount of ink and when amount of the ink-receiving layer is increased, peeling off (exfoliation in the form of powders) of the coat is apt to occur.

For inhibiting the permeation of an aqueous ink without increasing the amount of the ink-receiving layer, it can be considered to reduce the void capillary content in the ink-receiving layer and the support or to increase water repellency. As a result, however, permeation of ink into the ink-receiving layer or the support is delayed and the ink is in undried state and the ink overflows around dots formed by overlapping of inks or during running of the sheet on an ink jet printer, the sheet contacts with devices provided around sheet feeder and the printed portion is rubbed, resulting in stain of the printed portion called staining of background. When this stain occurs over a wide area, the non-image area is stained to damage the appearance and in addition, the adjacent dots contact with each other to cause spread of dots. As a result, clearness of the image decreases and color quality is deteriorated owing to mixing of colors and thus, image reproducibility is considerably deteriorated.

In order to avoid the occurrence of unevenness after printing, various proposals have been made and recently, it has been attempted to use a platy pigment and a binder having a glass transition temperature of 30°–60° C. in combination in a backcoat layer (Japanese Patent Application Kokai No. 4-298380). It is generally said that a treatment at a temperature higher than the glass transition temperature is necessary for assuring adhesiveness using an emulsion type binder and a treatment at a temperature at least about 60° C. higher than the glass transition temperature is necessary for developing a complete adhesiveness (Soichi Muroi, "Polymer Latex Adhesives" published from Kobunshi Publishing Association). Thus, in order to maintain adhesiveness and inhibit peeling of the backcoat layer, it is essential to increase amount of the binder or to treat the backcoat layer at a temperature higher than the glass transition temperature, preferably at least about 60° C. higher than the glass transition temperature.

However, increase of the amount of the binder causes the phenomenon of the sheets sticking to each other which is called blocking. In the ink jet recording apparatus having a mechanism where a plurality of sheets is set and printed one by one, the blocking brings about the problems that not only two or more sheets are delivered at one time, but also the sheet cannot be delivered owing to clogging of the sheets. Further problem encountered is that the ink-receiving layer is peeled and sticks to the backcoat layer because the blocking is a phenomenon of sticking of the backcoat layer and the ink-receiving layer to each other. Moreover, when adhesiveness of the backcoat layer is ensured by raising the drying temperature at the drying step after coating the backcoat layer, migration of the binder in the backcoat layer is accelerated and consequently, distribution of the binder in the backcoat layer becomes ununiform, resulting in formation of waviness already before printing.

In the ink jet recording sheet, since the ink-receiving layer, the backcoat layer and the support expand and contract by influence of temperature or humidity, the sheet is being required to have the property not to curl (curling resistance) under conditions of any temperatures and humidities with the spread of ink jet recording apparatuses. Curling of the recording sheet occurs due to the difference in expansion and contraction of the front side and the back side of the sheet with the change in temperature and humidity. For example, if the contraction of the front side is greater than that of the back side under the environment of low temperature, the recording sheet warps upwardly.

If the recording sheet lacks curling resistance, the sheet cannot be fed to or discharged from the ink jet recording apparatus owing to curling of the sheet and in addition, the problem of staining of the sheet also occurs. An attempt to ensure the curling resistance by using a polyethylene terephthalate film as a support is disclosed in Japanese Patent Application Kokai Nos.61-235184 and 62-282967. However, it is difficult to obtain curling resistance exhibited under any temperatures and humidities which has been recently required and furthermore, it is mostly impossible to obtain that effect in the recording sheet having a support mainly composed of a wood pulp and a pigment.

With recent increase in demand for visualization, the number of printed dots per unit area of the recording sheet increases in order to improve clearness and color quality. This means increase of the amount of permeating ink and as a result, undulation after printing readily occurs. Furthermore, with the spread of ink jet recording apparatus, the environment in which the recording is performed ranges from low temperature and low humidity to high temperature and high humidity and it is increasingly demanded to ensure curling resistance under conditions of any temperatures and any humidities. Furthermore, with increase in the speed of recording apparatuses, the required level for curling resistance becomes severer.

SUMMARY OF THE INVENTION

The object of the present invention is to provide an ink jet recording sheet which is inhibited from occurrence of undulation caused by absorption of ink after ink jet recording and surely possesses curling resistance unsusceptible to change in temperature and humidity.

After intensive research on ink jet recording sheets, the inventors have found that undulation of the sheet which occurs after printing can be very effectively inhibited and curling resistance unsusceptible to the change in temperature and humidity can be ensured by containing a specific synthetic polymer latex and a water-soluble binder in the back coat layer.

According to the present invention, an ink jet recording sheet which is superior in adhesion strength and curling resistance and is inhibited from undulation after printing can be obtained by providing a backcoat layer containing a synthetic polymer latex having a glass transition temperature of −50° to +25° C. and a water-soluble binder in combination and the object of the present invention cannot be attained by use of the latex and the water-soluble binder each alone.

That is, the present invention provides an ink jet recording sheet comprising a support mainly composed of a wood pulp and a pigment and at least one ink-receiving layer coated on one side of the support and one backcoat layer coated on the other side of the support wherein a binder of the backcoat layer comprises a synthetic polymer latex having a glass transition temperature of −50° to +25° C. as an essential component and additionally at least one of starches, polyvinyl alcohols and cellulose derivatives which are water-soluble binders.

Furthermore, in view of the fact that the edge of the ink jet recording sheet having no backcoat layer curls upwardly towards the ink-receiving layer side, the inventors have considered to avoid the curling not by controlling the force to generate curl by the backcoat layer or the support, but by generating a force to curl downwardly towards the side of the backcoat layer, and after intensive research, the inventors have found that the above-mentioned object of the present invention can be more effectively attained by specifying the pigment contained in the backcoat layer.

That is, the present invention further provides an ink jet recording sheet wherein the backcoat layer is mainly composed of a pigment and a binder and the pigment has an average equilibrium moisture content M of 1.9–5.5% by weight calculated from the following formula (1).

$$M=\sum_{i=1}^{n} MiWi \tag{1}$$

wherein M denotes an average equilibrium moisture content [% by weight], i denotes a variable which shows the kind of pigment, n denotes the number of the kind of the pigment contained ($n \geqq 1$), Mi denotes an equilibrium moisture content of pigment i [% by weight], and Wi denotes a weight ratio of the pigment i to the total pigment ($0<Wi \leqq 1$).

The equilibrium moisture content Mi is obtained from wet base moisture content defined by the following formula (2).

$$Mi=\{(Si-Di)/Si\}\times 100 \tag{2}$$

wherein Si denotes a mass of the pigment i left to stand for 24 hours under the conditions of 20° C.·65% RH, Di denotes a mass of the pigment i left to stand for 3 hours under the condition of 105° C. The measurement of the equilibrium moisture content Mi is conducted in such a procedure that first Di of the pigment i is obtained and then, Si is obtained.

DETAILED DESCRIPTION OF THE INVENTION

Figure 1:
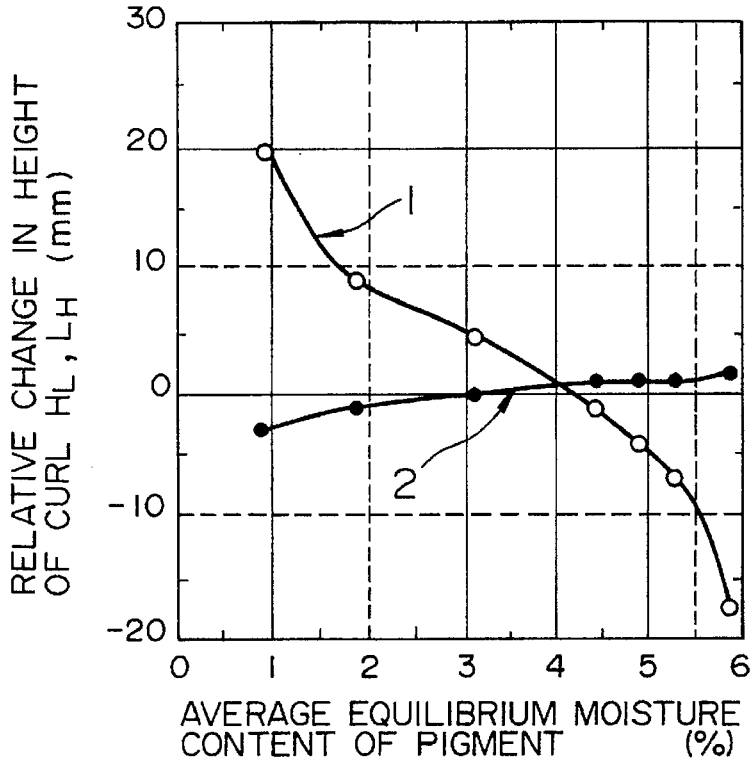
FIG. 1 is a graph which shows the relation between the average equilibrium moisture content of the pigment contained in the backcoat layer and the relative change in height of curl wherein curve 1 shows the relative change in height ($H_L$) of curl at 5° C.·10% RH and curve 2 shows the relative change in height ($H_H$) of curl at 40° C.·90% RH.

The support which is used in the present invention and on which the ink-receiving layer and the backcoat layer are coated includes a base paper prepared by mixing a known pigment and a wood pulp, for example, a chemical pulp such as LBKP or NBKP, a mechanical pulp such as GP, PGW, RMP, TMP, CTMP, CMP or CGP or a recycled fiber such as DIP with a binder and optionally at least one of the additives such as sizing agent, fixing agent, retention aid, cationizing agent and paper strengthing agent and making the resulting mixture into a paper by various apparatuses such as Foudrinier paper machine, cylinder paper machine and twin wire paper machine. The support further includes the above base papers on which a size press coating layer or an anchor coat layer of starch, polyvinyl alcohol or the like and coated papers such as art papers, coated papers and cast coat papers.

The ink-receiving layer may be provided on the resulting support as it is or the support may be subjected to calendering by machine calenders, TG calenders, soft calenders or the like for controlling the smoothness.

Furthermore, a polyolefin resin layer may be provided on the above base papers. The support further includes films of synthetic resins such as polyethylene, polypropylene, polyester, nylon, rayon and polyurethane or mixtures of these resins and sheets obtained by making the above synthetic resins into fibers and shaping the fibers into a sheet.

The base paper, the ink-receiving layer and the backcoat layer used in the present invention may contain at least one known white pigment. Examples of the white pigment are inorganic white pigments such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrated halloysite, magnesium carbonate and magesium hydroxide and organic pigments such as styrene plastics pigment, acrylic plastics pigment, polyethylene, microcapsules, urea resin and melamine resin.

Among them, porous inorganic pigments are preferred as white pigments to be contained in the ink-receiving layer as a main component and include, for example, porous synthetic amorphous silica, porous magnesium carbonate and porous alumina and the porous synthetic amorphous silica having a large pore volume is especially preferred.

The synthetic polymer latexes used in the present invention include homopolymers and copolymers of vinyl acetate, styrene, ethylene, vinyl chloride, acrylic acid, isobutylene, chloroprene, butadiene, acrylonitrile, methyl methacrylate, acrylate esters and these polymers which are modified with carboxyl group. At least one of them must be contained in the backcoat layer.

It is required that the synthetic polymer latexes have a glass transition temperature of −50° to +25° C. The desired glass transition temperature can be obtained by changing the amount of the components or by blending two or more latexes. The glass transition temperature may also be adjusted by copolymerizing film forming aids or plasticizers such as higher alkyl acrylates and fumaric acid.

The starches used in the present invention include oxidized starches, acetylated starches, hydroxyethylated starches, etherified starches, esterified starches, enzyme-modified starches, thermochemically modified starches and dextrins of maize, potato, tapioca, wheat and the like. They further include cold water-soluble starches obtained by flash drying the above starches. The cellulose derivatives used in the present invention are water-soluble cellulose binders such as methylcellulose, ethylcellulose, cellulose acetate, hydroxymethylcellulose, carboxymethylcellulose and carboxyethylcellulose.

The polyvinyl alcohols used in the present invention are polymer compounds of the structural formula $(CH_2C(OH)H)_n$ produced by hydrolysis of polyvinyl acetate and having the polymerization degree n of 500 or higher and a saponification degree of 87 or higher. If the polymerization degree is lower than 500 or the saponification degree is lower than 87, viscosity is low at the time of coating and control of coating amount is difficult. Preferably, the polymerization degree is 500–2500 and the saponification degree is 87 or higher though it depends on concentration of the coating composition. Use of a silanol group containing polyvinyl alcohol provides a backcoat layer high in water resistance against permeation of aqueous ink or moisture and the effect of the present invention can be further enhanced.

In the ink-receiving layer of the present invention, synthetic polymer latexes, starches, polyvinyl alcohols and water-soluble cellulose binders can be used as binders for the above-mentioned pigments. The total amount of the binders can be optionally adjusted depending on the characteristics of the desired ink jet recording sheet, but is generally 5–60% by weight based on 100% by weight of the pigment. The ink-receiving layer may further contain other additives such as pigment dispersant, thickening agent, fluidity improver, antifoamer, foam inhibitor, releasing agent, foaming agent, penetrant, coloring dye, coloring pigment, fluorescent brightener, ultraviolet absorber, antioxidant, preservative, slimecide, water proofing agent, wet strengthening agent and dry strengthening agent.

The object of the present invention is attained by containing a synthetic polymer latex having a glass transition temperature of −50° to +25° C. as an essential binder and additionally containing at least one of starch, polyvinyl alcohol and water-soluble cellulose binders as binders for the pigment in the ink-receiving layer. If the coating amount of the backcoat layer is less than 3 g/m$^2$, satisfactory curl resistance cannot be obtained and if it is more than 30 g/m$^2$, rather undulation of the sheet occurs due to migration of the binder at the steps of coating and drying. Therefore, the coating amount is preferably 3–30 g/m$^2$. The backcoat layer may further contain other additives such as pigment dispersant, thickening agent, fluidity improver, antifoamer, foam inhibitor, releasing agent, foaming agent, penetrant, coloring dye, coloring pigment, fluorescent brightener, ultraviolet absorber, antioxidant, preservative, slimecide, water proofing agent, wet strengthening agent and dry strengthening agent.

It is preferred that the backcoat layer of the present invention contains the above-mentioned pigment alone or in combination of two or more so that the average equilibrium moisture content obtained by the above-mentioned formula (1) is within the specific range of 1.9–5.5% by weight. As binders, those which are mentioned above can be used. The total amount of the binders is 5–60 parts by weight, preferably 10–50 parts by weight based on 100 parts by weight of the pigment. If the amount of the binder is less than 5 parts, adhesion strength decreases and if it is more than 60 parts, expansion and contraction caused by the binder greatly affects the curl resistance.

The coating weight $W_B$ of the backcoat layer is desirably set in connection with the coating weight $W_I$ of the ink-receiving layer. Preferably, $W_B$ is 3 g/m$^2$ or more and $(W_B-W_I)$ is −10 to 25 g/m$^2$. If $W_B$ is less than 3 g/m$^2$ or $(W_B-W_I)$ is less than −10 g/m$^2$, it is difficult to inhibit the curling of the sheet towards the ink-receiving layer side. Even if $(W_B-W_I)$ is more than 25 g/m$^2$, the effect to inhibit the curling cannot be enhanced and productivity decreases and this is not economical.

For coating of the ink-receiving layer or backcoat layer, there may be used various apparatuses such as blade coater, roll coater, air knife coater, bar coater, rod blade coater, short dowel coater and size press in the manner of on-machine or off-machine. After coating, the sheet may be finished by calenders such as machine calender, TG calender, super calender and soft calender.

The aqueous ink referred to in the present invention is a recording solution comprising the following colorant, vehicle and other additives.

The colorants include water-soluble dyes such as direct dyes, acid dyes, basic dyes, reactive dyes and food dyes.

The vehicles for the aqueous ink include water and various water-soluble organic solvents, for example, alkyl alcohols of 1 to 4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethylformamide and dimethylacetamide; ketones or ketone alcohols such as acetone and diacetone alcohol; ethers such as tetrahydrofuran and dioxane; polyalkylene glycols such as polyethylene glycol and polypropylene glycol; alkylene glycols having 2 to 6 alkylene groups such as ethylene glycol, propylene glycol, butylene glycol, triethylene glycol, 1,2,6-hexanetriol, thiodiglycol, hexylene glycol and diethylene glycol; and lower alkyl ethers of polyhydric alcohols such as glycerin, ethylene glycol methyl ether, diethylene glycol methyl (or ethyl) ether and triethylene glycol monomethyl ether. Of these water-soluble organic solvents, preferred are polyhydric alcohols such as diethylene glycol and lower alkyl ethers of polyhydric alcohols such as triethylene glycol monomethyl ether and triethylene glycol monoethyl ether. As the other buffers, mention may be made of, for example, pH adjustors, sequestering agents, slimecides, viscosity modifiers, surface tension modifiers, wetting agents, surface active agents and rust preventives.

The ink jet recording sheet of the present invention can be used not only as ink jet recording sheets, but also as any sheets recordable by use inks liquid at the time of recording are used. These recording sheets include, for example, receiving sheets for heat transfer recording, where a donor sheet comprising a thin support such as a resin film and a heat-meltable ink layer provided thereon mainly composed of a heat-meltable wax and colorants is heated from the back side to fuse the ink layer and let it transfer; a specific ink jet recording sheet where a solid but heat-fusible ink is molten and jetted onto it to carry out recording, an another specific ink jet recording sheets where an ink solution is oleophilic one containing an oil-soluble dye therein; and a receiving sheet to be used with a photo/pressure sensitive donor sheet coated with micro-capsules containing a photopolymerizable monomer and colorless or colored dye or pigment.

These recording sheets are common in that the ink used is in a liquid state at recording. A liquid ink permeates or diffuses vertically and horizontally into the ink-receiving layer until the ink is hardened, solidified or fixed. The above-mentioned various recording sheets require the ink absorbency in conformity with the respective recording methods and the ink jet recording sheet of the present invention can be utilized as the above-mentioned various recording sheets.

The ink jet recording sheet of the present invention can be used as recording sheets for electro-photographic recording on which a toner is fixed by heating and which are widely used in copying machines, printers and the like.

In order to prevent undulation of the sheet which occurs after printing and secure the curl resistance which are the objects of the present invention, it is necessary that the backcoat layer contains a synthetic polymer latex having a glass transition temperature of −50° to +25° C., preferably −40° to +25° C. as an essential component and additionally at least one of starches, polyvinyl alcohols and cellulose derivatives.

If the backcoat layer contains a synthetic polymer latex having a glass transition temperature of lower than −50° C., blocking resistance is inferior although adhesion strength is high and a problem is encountered that the recording sheets stick to each other. If the glass transition temperature of the latex is higher than +25° C. or the latex is not contained, adhesion strength decreases and in addition, occurrence of undulation of the sheet after printing cannot be inhibited by the backcoat layer. When amount of the latex is increased for avoiding decrease in pick resistance, the sheet has undulation already before printing.

Curling resistance cannot be secured unless starch, polyvinyl alcohol and/or cellulose derivative are used. This is considered to relate to the chain-like form of starch, polyvinyl alcohol and cellulose derivative and to the properties of the polymer shown by the glass transition temperature. That is, it is considered that when the backcoat layer containing the starch, polyvinyl alcohol and cellulose derivative having a chain-like form is coated and dried, the chain-like form is extended in the depth and planar directions of the backcoat layer to form a strong layer. Furthermore, it is considered that since the glass transition temperature of the starch, polyvinyl alcohol and cellulose derivative is generally higher than about +65° C., which is higher than the environmental temperature at which the ink jet recording apparatus is used, the backcoat layer containing the starch, polyvinyl alcohol and cellulose derivative inhibits the occurrence of curl in the ink jet recording sheet.

However, even if glass transition temperature of particulate materials such as synthetic polymer latexes is increased, it is difficult to ensure curling resistance. It is considered this is because decrease of the curling resistance occurs in the same mechanism as the decrease of adhesion strength due to the high glass transition temperature. That is, the adhesion strength of the latex is generated by treating the latex at a temperature higher than the glass transition temperature to form a film. Accordingly, unless the whole of the coat becomes filmy, pick resistance decreases and curling resistance also decreases. On the other hand, even if the treating temperature is lower than the glass transition temperature, starch and polyvinyl alcohol can secure the pick resistance if the solvent is evaporated and the problem encountered in the latex can be avoided.

Curls are generated due to the differences in expansion and contraction of the front side and the back side of the ink jet recording sheet caused by changes in temperature and humidity. In the course of production of the recording sheet, blending conditions and production conditions of the support, ink-receiving layer and backcoat layer are set considering the curling resistance and in general the sheet is produced so that the equilibrium moisture content is 3–8% by weight. However, the equilibrium moisture content in the environment in which the recording sheet is used differs from the equilibrium moisture content at the time of production, and the sheet is used under the environmental conditions of smaller than 3% by weight or greater than 8% by weight. Therefore, the recording sheet expands or contracts to generate curls.

For example, under the conditions of low temperature and low humidity, the equilibrium moisture content of the recording sheet is lower than that at the time of preparation of the sheet and therefore the sheet contracts and is apt to curl towards the front side or the back side which is higher in contraction. The difference in contraction between the front and back sides of the sheet is due to the contraction properties peculiar to the support, the ink-receiving layer and the backcoat layer which constitute the sheet and the contraction properties of the support, the ink-receiving layer and the backcoat layer are balanced at the time of preparation of the sheet to ensure the curling resistance, but when the equilibrium moisture content changes, this balance is lost to generate curls. Similarly, under the conditions of high temperature and high humidity the equilibrium moisture content of the recording sheet is higher than that at the time of preparation of the sheet and curls are generated due to the difference in expansion properties of the recording sheet. Accordingly, when the recording sheet contracts in the ink-receiving layer side and curls towards the ink-receiving layer side, the curling can be avoided by providing a coating layer resisting against the contraction in the backcoat layer side or a coating layer which contracts in the backcoat layer side.

The inventors have evaluated the curling by providing a coating layer on one side of the support and found that the degree of curling differs depending on the pigments added to the coating layer and that the coating layer containing a pigment higher in equilibrium moisture content shows greater curling under low temperature and low humidity. This means that a coating layer containing a pigment higher in equilibrium moisture content is greater in expansion and contraction and it has been found that an ink jet recording sheet excellent in curling resistance can be obtained when a coating layer containing a pigment higher in equilibrium moisture content is coated on the side opposite to the side coated with the ink-receiving layer. It is not clear why this phenomenon occurs, but it is considered that under the conditions of low temperature and low humidity, the contractive force of the backcoat layer side which balances with the contractive force of the ink-receiving layer side is developed in the backcoat layer and as a result, curling towards the ink-receiving layer side and curling towards the backcoat layer side offsets each other to inhibit the occurrence of curling. Under the conditions of high temperature and high humidity, expansion of the ink-receiving layer side is considered to be inhibited by the backcoat layer.

The backcoat layer contains one or two or more pigments and if average value of equilibrium moisture content (average equilibrium moisture content) inherent to the pigments is high, the phenomenon on curling is similarly obtained. When the average equilibrium moisture content is 1.9–5.5% by weight, curling resistance can be ensured. Especially, under low temperature and low humidity conditions, excellent curling resistance can be obtained. If the average equilibrium moisture content is less than 2% by weight, the contraction of the ink-receiving layer side is greater than that of the backcoat layer side and curling towards the ink-receiving layer side occurs. If it is more than 5.5% by weight, curling towards the backcoat layer side is apt to occur. Under the conditions of high temperature and high humidity, there occurs no change in curling when the average equilibrium moisture content is 1.9–5.5% by weight.

DESCRIPTION OF THE PREFERRED EMBODIMENTS

The following examples are illustrative of the present invention and are not intended for purposes of limitation. All "part" and "%" are by weight unless otherwise notified.

(1) Undulation:

Monochromatic dots of cyan ink, magenta ink and yellow ink are overlapped to print overlapped ink dots on the whole surface of the sheet (A4 size, 210 mm×297 mm) and the printed surface of the sheet is visually judged and graded by the following criteria. The grades A and B have no problem in quality.

A: No undulation is seen and appearance is not damaged.

B: Undulation is small and appearance is not damaged.

C: Undulation is great and appearance is damaged.

(2) Curl:

Samples (A4 size) obtained in the following Examples and Comparative Examples are left to stand under each of the conditions: 5° C.·10% RH, 20° C.·65% RH and 40° C.·90% RH. Thereafter, the samples are placed on a desk and heights (H) of curls at the four corners of the sample are measured. In this case, the sample is placed so that it curls upwardly and the height of the curl at the four corners is measured. The results are graded by the following criteria.

A: $0 \leqq H < 5$ (mm): Good

B: $5 \leqq H \leqq 10$ (mm): Practically acceptable.

C: $10 < H$ (mm): Running property of sheet greatly deteriorates and this is practically unacceptable.

(3) Pick resistance:

A commercially available adhesive cellophane tape is applied to the surface of the backcoat layer and peeled. Degree of picking by the adhesive tape was visually inspected and graded by the following criteria. The grades A and B indicate that there are practically no problems.

A: No picking by the adhesive tape was observable; good pick resistance.

B: Some trace of picking observable; practically acceptable.

C: Appreciable picking observable; practically unacceptable.

(4) Blocking:

Ten sheets of the samples of A4 size were superposed and a weight of 3 kg was put thereon and these superposed sheets are left to stand for 24 hours under the conditions of 40° C.·90% RH. Thereafter, the blocking is visually inspected and graded by the following criteria. The grades A and B mean that the samples have no problem in quality in this regards.

A: No blocking observable.

B: Slight blocking observable, but there is no practically problem in transferability of the sheet.

C: Considerably blocking and ink-receiving layer peeled off. This is practically unacceptable.

EXAMPLE 1

A support was produced by mixing 100 parts of a wood pulp comprising 80 parts of LBKP (freeness: 400 ml csf) and 20 parts of NBKP (freehess: 450 ml csf) with 25 parts of pigments comprising precipitated calcium carbonate/ground calcium carbonate/talc (30/35/35), 0.10 part of commercially available alkyl ketene dimer, 0.03 part of commercially available cationic acrylamide, 0.8 part of commercially available cationized starch and 0.4 part of aluminum sulfate and making the resulting mixture into a paper of 90 g/m$^2$ in basis weight by a Fourdrinier paper machine. An ink-receiving layer and a backcoat layer were provided on the front side and on the back side of the resulting support, respectively and subjected to calendering treatment to obtain an ink jet recording sheet.

The ink-receiving layer was provided in the following manner. A coating composition for ink-receiving layer comprising 100 parts of a synthetic amorphous silica (Finesil X37B manufactured by Tokuyama Soda Co., Ltd.), 50 parts of polyvinyl alcohol (PVA 117 manufactured by Kuraray Co., Ltd.) and 20 parts of a cationic dye fixer (Sumirase Resin 1001 manufactured by Sumitomo Chemical Co., Ltd.) was prepared. The resulting coating composition had a solid concentration of 13%. The coating composition was coated on the front side of the support at a coating weight of 8 g/m$^2$ by an airknife coater.

The backcoat layer was provided on another side of the support in the following manner. 100 parts of kaolin (Hydrasperse manufactured by Huber Corp.) was mixed with 5 parts of a silanol group containing polyvinyl alcohol (R Polymer 1130 manufactured by Kuraray Co., Ltd.) and 10 parts of an acrylic latex having a glass transition temperature of 25° C. (Boncoat AN 127 manufactured by Dainippon Ink & Chemicals Inc.) to prepare a coating composition of 35% in solid concentration for backcoat layer. The resulting coating composition was coated at a coating weight of 8 g/m$^2$ on the opposite side to the ink-receiving layer side and subjected to calendering treatment to obtain an ink jet recording sheet.

EXAMPLES 2–15 AND COMPARATIVE EXAMPLES 1–6

The support and the ink-receiving layer were obtained in the same manner as in Example 1. The coating composition for the backcoat layer was prepared by mixing 100 parts of kaolin with the synthetic polymer latex as shown in Tables 1 and 2 and further with the polyvinyl alcohol, starch and cellulose derivative. The backcoat layer was provided in the same manner as in Example 1. In Comparative Example 6, the latex was not used.

Compositions and results of evaluation of the properties of the ink jet recording sheets obtained in the examples and the comparative examples are shown in Tables 1 and 2.

TABLE 1

| | Example 1 | Example 2 | Example 3 | Example 4 | Example 5 | Example 6 | Example 7 | Example 8 |
|---|---|---|---|---|---|---|---|---|
| [Support] | | | | | | | | |
| LBKP (part) | 80 | | | | | | | |
| NBKP (part) | 20 | | | | | | | |
| Pigment (part) | 25 | | | | | | | |
| Precipitated calcium carbonate (part) | 7.5 | | | | | | | |
| Ground calcium carbonate (part) | 8.75 | | | | | | | |
| Talc (part) | 8.75 | | | | | | | |
| Alkyl ketene dimer (part) | 0.10 | | | | | | | |
| Cationic acrylamide (part) | 0.03 | | | | | | | |
| Cationized starch (part) | 0.8 | | | | | | | |
| Aluminum sulfate (part) | 0.4 | | | | | | | |
| Basis weight (g/m$^2$) | 90 | | | | | | | |
| [Ink-receiving layer] | | | | | | | | |
| Synthetic amorphous silica (part) | 100 | | | | | | | |
| PVA 117 (part) | 50 | | | | | | | |
| Cationic dye fixer (part) | 20 | | | | | | | |
| Solid concentration (%) | 13 | | | | | | | |
| Coating weight (g/m$^2$) | 8 | | | | | | | |
| Coating method | Airknife | | | | | | | |
| [Backcoat layer] | | | | | | | | |
| Kaolin (part) | 100 | | | | | | | |
| Equilibrium moisture content of pigment | 1.2% by weight | | | | | | | |
| Silanol group containing PVA (part) | 5 | — | — | 5 | 5 | 5 | 5 | — |
| Polyvinyl alcohol[1)] (part) | — | — | — | — | — | — | — | — |
| Oxidized starch (part) | — | 5 | — | — | — | — | — | — |
| Phosphate esterified starch (part) | — | — | — | — | — | — | — | 5 |
| Carboxymethylcellulose (part) | — | — | 1 | — | — | — | — | — |
| Hydroxyethylcellulose (part) | — | — | — | — | — | — | — | — |
| SBR latex (part) | — | — | — | 10 | 10 | 10 | 10 | 10 |
| Acrylic latex (part) | 10 | 10 | 10 | — | — | — | — | — |
| Tg of latex (°C.) | +25 | +25 | +25 | +20 | +5 | −10 | −45 | −45 |
| Solid concentration (%) | 35 | | | | | | | |
| Coating weight (g/m$^2$) | 8 | | | | | | | |
| Undulation after printing | A | A | B | A | A | A | B | B |
| Curl | | | | | | | | |
| 5° C. 10% | B | B | B | B | A | A | A | A |
| 20° C. 65% | A | A | A | A | A | A | A | A |
| 40° C. 90% | A | A | A | A | A | A | A | A |
| Pick resistance | B | B | B | A | A | A | A | A |
| Blocking | A | A | A | A | A | A | B | A |
| Calendering linear pressure (kg/cm) | 200 | | | | | | | |

| | Example 9 | Example 10 | Example 11 | Example 12 | Example 13 | Example 14 | Example 15 |
|---|---|---|---|---|---|---|---|
| [Support] | | | | | | | |
| LBKP (part) | | | | | | | |
| NBKP (part) | | | | | | | |

TABLE 1-continued

| | | | | | | | |
|---|---|---|---|---|---|---|---|
| Pigment (part) | | | | | | | |
| Precipitated calcium carbonate (part) | | | | | | | |
| Ground calcium carbonate (part) | | | | | | | |
| Talc (part) | | | | | | | |
| Alkyl ketene dimer (part) | | | | | | | |
| Cationic acrylamide (part) | | | | | | | |
| Cationized starch (part) | | | | | | | |
| Aluminum sulfate (part) | | | | | | | |
| Basis weight (g/m$^2$) | | | | | | | |
| [Ink-receiving layer] | | | | | | | |
| Synthetic amorphous silica (part) | | | | | | | |
| PVA 117 (part) | | | | | | | |
| Cationic dye fixer (part) | | | | | | | |
| Solid concentration (%) | | | | | | | |
| Coating weight (g/m$^2$) | | | | | | | |
| Coating method | | | | | | | |
| [Backcoat layer] | | | | | | | |
| Kaolin (part) | | | | | | | |
| Equilibrium moisture content of pigment | | | | | | | |
| Silanol group containing PVA (part) | 5 | 5 | 3 | 3 | 5 | 5 | — |
| Polyvinyl alcohol[1)] (part) | — | — | — | — | — | — | 5 |
| Oxidized starch (part) | — | — | — | — | — | — | — |
| Phosphate esterified starch (part) | — | — | 2 | 2 | — | — | — |
| Carboxymethylcellulose (part) | 1 | — | — | 1 | — | — | — |
| Hydroxyethylcellulose (part) | — | 1 | — | — | — | — | — |
| SBR latex (part) | 10 | 10 | 10 | 10 | 10 | 10 | 10 |
| Acrylic latex (part) | — | — | — | — | — | — | — |
| Tg of latex (°C.) | +20 | +20 | +20 | +20 | −40 | −50 | +20 |
| Solid concentration (%) | | | | | | | |
| Coating weight (g/m$^2$) | | | | | | | |
| Undulation after printing | A | A | A | A | A | B | A |
| Curl | | | | | | | |
| 5° C. 10% | A | A | A | A | A | B | B |
| 20° C. 65% | A | A | A | A | A | B | A |
| 40° C. 90% | A | A | A | A | A | A | A |
| Pick resistance | A | A | A | A | A | A | B |
| Blocking | A | A | A | A | A | B | A |
| Calendering linear pressure (kg/cm) | | | | | | | |

TABLE 2

| | Comp. Example 1 | Comp. Example 2 | Comp. Example 3 | Comp. Example 4 | Comp. Example 5 | Comp. Example 6 |
|---|---|---|---|---|---|---|
| [Support] | | | | | | |
| LBKP (part) | 80 | | | | | |
| NBKP (part) | 20 | | | | | |
| Pigment (part) | 25 | | | | | |
| Precipitated calcium carbonate (part) | 7.5 | | | | | |
| Ground calcium carbonate (part) | 8.75 | | | | | |
| Talc (part) | 8.75 | | | | | |
| Alkyl ketene dimer (part) | 0.10 | | | | | |
| Cationic acrylamide (part) | 0.03 | | | | | |
| Cationized starch (part) | 0.8 | | | | | |
| Aluminum sulfate (part) | 0.4 | | | | | |
| Basis weight (g/m$^2$) | 90 | | | | | |
| [Ink-receiving layer] | | | | | | |
| Synthetic amorphous silica (part) | 100 | | | | | |
| PVA 117 (part) | 50 | | | | | |
| Cationic dye fixer (part) | 20 | | | | | |
| Solid concentration (%) | 13 | | | | | |
| Coating weight (g/m$^2$) | 8 | | | | | |
| Coating method | Airknife | | | | | |
| [Backcoat layer] | | | | | | |
| Kaolin (part) | 100 | | | | | |
| Equilibrium moisture content of pigment | 1.2% by weight | | | | | |
| Silanol group containing PVA (part) | 5 | 5 | 5 | 5 | — | 10 |
| Oxidized starch (part) | — | — | — | — | — | 10 |

TABLE 2-continued

| | Comp. Example 1 | Comp. Example 2 | Comp. Example 3 | Comp. Example 4 | Comp. Example 5 | Comp. Example 6 |
|---|---|---|---|---|---|---|
| Phosphate esterified starch (part) | — | — | — | — | — | — |
| Carboxymethylcellulose (part) | — | — | — | — | — | — |
| Hydroxyethylcellulose (part) | — | — | — | — | — | — |
| SBR latex (part) | 10 | 10 | — | 10 | — | — |
| Acrylic latex (part) | — | — | 10 | — | 30 | — |
| Tg of latex (°C.) | −60 | +40 | +45 | +80 | +45 | — |
| Solid concentration (%) | 35 | | | | | |
| Coating weight (g/m$^2$) | 8 | | | | | |
| Undulation after printing | B | A | A | C | C[2)] | A |
| Curl | | | | | | |
| 5° C. 10% | C | B | B | C | C | A |
| 20° C. 65% | B | B | B | B | B | A |
| 40° C. 90% | A | A | A | A | A | A |
| Pick resistance | A | C | C | C | A | C |
| Blocking | C | A | A | A | A | A |
| Calendering linear pressure (kg/cm) | 200 | | | | | |

Note:
[2)]Waviness of grade C occurred before printing.

As is clear from the above results, according to the present invention, there are obtained ink jet recording sheets inhibited from occurrence of undulation caused by absorption of ink after ink jet recording and surely possessing curling resistance hardly influenced by the change in temperature and humidity.

EXAMPLE 16

A support was produced by mixing 100 parts of a wood pulp comprising 80 parts of LBKP (freeness: 400 ml csf) and 20 parts of NBKP (freeness: 450 ml csf) with 25 parts of pigments comprising precipitated calcium carbonate/ground calcium carbonate/talc (30/35/35), 0.10 part of commercially available alkyl ketene dimer, 0.03 part of commercially available cationic acrylamide, 0.8 part of commercially available cationized starch and 0.4 part of aluminum sulfate and making the mixture into a paper of 90 g/m$^2$ in basis weight by a Fourdrinier paper machine to obtain a support.

An ink-receiving layer was provided in the following manner. A coating composition for ink-receiving layer comprising 100 parts of a synthetic amorphous silica (Finesil X37B manufactured by Tokuyama Soda Co., Ltd.), 50 parts of polyvinyl alcohol (PVA 117 manufactured by Kuraray Co., Ltd.) and 20 parts of a cationic dye fixer (Sumirase Resin 1001 manufactured by Sumitomo Chemical Co., Ltd.) was prepared. The resulting coating composition had a solid concentration of 13%. The coating composition was coated on the front side of the support at a coating weight of 10 g/m$^2$ by an air knife coater.

Furthermore, a backcoat layer was provided on another side of the support in the following manner. 100 parts of a pigment having an equilibrium moisture content of 4.9% by weight (hydrated halloysite KA Press manufactured by Oharu Kagaku Co.) was dispersed with 0.4 part of commercially available sodium polyacrylate and to the dispersion were added 5 parts of a silanol group containing polyvinyl alcohol (R Polymer 1130 manufactured by Kuraray Co., Ltd.) and 15 parts (solid content) of a styrene-butadiene latex (0693 manufactured by Japan Synthetic Rubber Co., Ltd.) to prepare a coating composition of 35% in solid concentration for backcoat layer. The resulting coating composition was coated at a coating weight of 8 g/m$^2$ on the opposite side to the ink-receiving layer side and subjected to calendering treatment to obtain an ink jet recording sheet.

The average equilibrium moisture content of the pigment added to the backcoat layer of Example 16 was 4.9% by weight (same as the equilibrium moisture content because only one pigment was added).

EXAMPLE 17

The support and the ink-receiving layer were obtained in the same manner as in Example 16. The coating composition for the backcoat layer was prepared in the same manner as in Example 16 except that 50 parts of the pigment used in Example 16 and 50 parts of a pigment having an equilibrium moisture content of 1.2% by weight (Delaminated clay; Nuclay manufactured by Engelhard Co.) were used in combination as the pigment. The resulting coating composition was coated in the same manner as in Example 16, followed by calendering treatment to obtain an ink jet recording sheet.

The average equilibrium moisture content of the pigment added to the backcoat layer in this Example 17 was 3.1% by weight.

EXAMPLE 18

The support and the ink-receiving layer were obtained in the same manner as in Example 16. The coating composition for the backcoat layer was prepared in the same manner as in Example 16 except that 20 parts of the pigment used in Example 16 and 80 parts of a pigment having an equilibrium moisture content of 1.2% by weight (No. 2 clay; Hydrasperse manufactured by Huber Corp.) were used in combination as the pigment. The resulting coating composition was coated in the same manner as in Example 16, followed by calendering treatment to obtain an ink jet recording sheet.

The average equilibrium moisture content of the pigments added to the backcoat layer in this Example 18 was 1.9% by weight.

EXAMPLE 19

The support and the ink-receiving layer were obtained in the same manner as in Example 16. The coating composition for the backcoat layer was prepared in the same manner as in Example 16 except that 90 parts of the pigment used in Example 16 and 10 parts of a pigment having an equilibrium moisture content of 0.3% by weight (ground calcium carbonate; Softon 2200 manufactured by Bihoku Funka Kogyo Co.) were used in combination as the pigment. The resulting coating composition was coated in the same manner as in Example 16, followed by calendering treatment to obtain an ink jet recording sheet.

The average equilibrium moisture content of the pigments added to the backcoat layer in this Example 19 was 4.4% by weight.

EXAMPLE 20

The support and the ink-receiving layer were obtained in the same manner as in Example 16. The coating composition for the backcoat layer was prepared in the same manner as in Example 16 except that 90 parts of a pigment having an equilibrium moisture content of 5.9% by weight (hydrated halloysite; NAG manufactured by Shinshu Kaolin Co.) and 10 parts of a pigment having an equilibrium moisture content of 0.3% by weight (ground calcium carbonate; Softon 2200 manufactured by Bihoku Funka Kogyo Co.) were used in combination as the pigment. The resulting coating composition was coated in the same manner as in Example 16, followed by calendering treatment to obtain an ink jet recording sheet.

The average equilibrium moisture content of the pigments added to the backcoat layer in this Example 20 was 5.3% by weight.

EXAMPLE 21

The support and the ink-receiving layer were obtained in the same manner as in Example 16. The coating composition for the backcoat layer was prepared in the same manner as in Example 16 except that 100 parts of a pigment having an equilibrium moisture content of 5.9% by weight (hydrated halloysite; NAG manufactured by Shinshu Kaolin Co.) was used as the pigment. The resulting coating composition was coated in the same manner as in Example 16, followed by calendering treatment to obtain an ink jet recording sheet.

The average equilibrium moisture content of the pigments added to the backcoat layer in this Example 21 was 5.9% by weight (same as the equilibrium moisture content because only one pigment was used).

EXAMPLE 22

The support and the ink-receiving layer were obtained in the same manner as in Example 16. The coating composition for the backcoat layer was prepared in the same manner as in Example 16 except that 10 parts of a pigment having an equilibrium moisture content of 5.9% by weight (hydrated halloysite; NAG manufactured by Shinshu Kaolin Co.) and 90 parts of a pigment having an equilibrium moisture content of 0.3% by weight (ground calcium carbonate; Softon 2200 manufactured by Bihoku Funka Kogyo Co.) were used in combination as the pigment. The resulting coating composition was coated in the same manner as in Example 16, followed by calendering treatment to obtain an ink jet recording sheet.

The average equilibrium moisture content of the pigments added to the backcoat layer in this Example 22 was 0.9% by weight.

With reference to the ink jet recording sheets obtained in Examples 16–22, relative change in height of curl was measured in the following manner:

The specimen sheets (A4 size) obtained in the following Examples and Comparative Examples were allowed to stand under each of the three conditions: 5° C. 10% RH, 20° C. 65% RH and 40° C. 90% RH. Thereafter, the sheets were placed on a flat table and heights (H) of curls at the four corners of the sheet were measured. The relative change in height of curl is a difference between the height of the curl after having undergone the 20° C. 65% RH condition as a control ($H_M$) and same after having undergone the other conditions. The relative change in height of curl after having undergone the 5° C. 10% RH and 40° C. 90% RH condition is referred to as $H_L$ and $H_H$ respectively, to which plus (+) and minus (–) is suffixed depending on the curl directions, towards the ink-receiving layer side and towards the backcoat layer side, respectively. If each of the measures, $H_L$, $H_H$ and $H_L$–$H_H$, fails to fall within ±10 (mm), the specimen sheet under this test is determined unsuccessful.

TABLE 3

| | Example 16 | Example 17 | Example 18 | Example 19 | Example 20 | Example 21 | Example 22 |
|---|---|---|---|---|---|---|---|
| [Support] | | | | | | | |
| LBKP (part) | 80 | | | | | | |
| NBKP (part) | 20 | | | | | | |
| Pigment (part) | 25 | | | | | | |
| Precipitated calcium carbonate (part) | 7.5 | | | | | | |
| Ground calcium carbonate (part) | 8.75 | | | | | | |
| Talc (part) | 8.75 | | | | | | |
| Alkyl ketene dimer (part) | 0.10 | | | | | | |
| Cationic acrylamide (part) | 0.03 | | | | | | |
| Cationized starch (part) | 0.8 | | | | | | |
| Aluminum sulfate (part) | 0.4 | | | | | | |
| Basis weight (g/m$^2$) | 90 | | | | | | |
| Ash content (%) | 17.9 | | | | | | |
| [Ink-receiving layer] | | | | | | | |
| Synthetic amorphous silica (part) | 100 | | | | | | |
| PVA 117 (part) | 50 | | | | | | |
| Cationic dye fixer (part) | 20 | | | | | | |
| Solid concentration (%) | 13 | | | | | | |
| Coating weight (g/m$^2$) | 10 | | | | | | |
| Coating method | Airknife | | | | | | |

TABLE 3-continued

| | Example 16 | Example 17 | Example 18 | Example 19 | Example 20 | Example 21 | Example 22 |
|---|---|---|---|---|---|---|---|
| [Backcoat layer] | | | | | | | |
| Hydrated halloysite KA (part) | 100 | 50 | 20 | 90 | — | — | — |
| Hydrated halloysite NGA (part) | — | — | — | — | 90 | 100 | 100 |
| Delaminated clay (part) | — | 50 | — | — | — | — | — |
| No. 2 clay (kaolin) (part) | — | — | 80 | — | — | — | — |
| Ground calcium carbonate (part) | — | — | — | 10 | 10 | — | 90 |
| Average equilibrium moisture content of pigment (wt %) | 4.9 | 3.1 | 1.9 | 4.4 | 5.3 | 5.9 | 0.9 |
| Sodium polyacrylate (part) | 0.4 | | | | | | |
| Silanol group containing PVA (part) | 5 | | | | | | |
| SBR latex 0693 (part) | 15 | | | | | | |
| Tg of latex (°C.) | +20 | | | | | | |
| Solid concentration (%) | 35 | | | | | | |
| Coating weight (g/m$^2$) | 8 | | | | | | |
| Relative change in height of curl (mm) | | | | | | | |
| HL | −4 | +5 | +9 | −1 | −6 | −17 | +20 |
| HH | +1 | 0 | −1 | +1 | +1 | 0 | −3 |
| HH-HL (mm) | +5 | −5 | −10 | +2 | +7 | +17 | −23 |
| Calendering linear pressure (kg/cm) | 200 | | | | | | |

Figure 2:
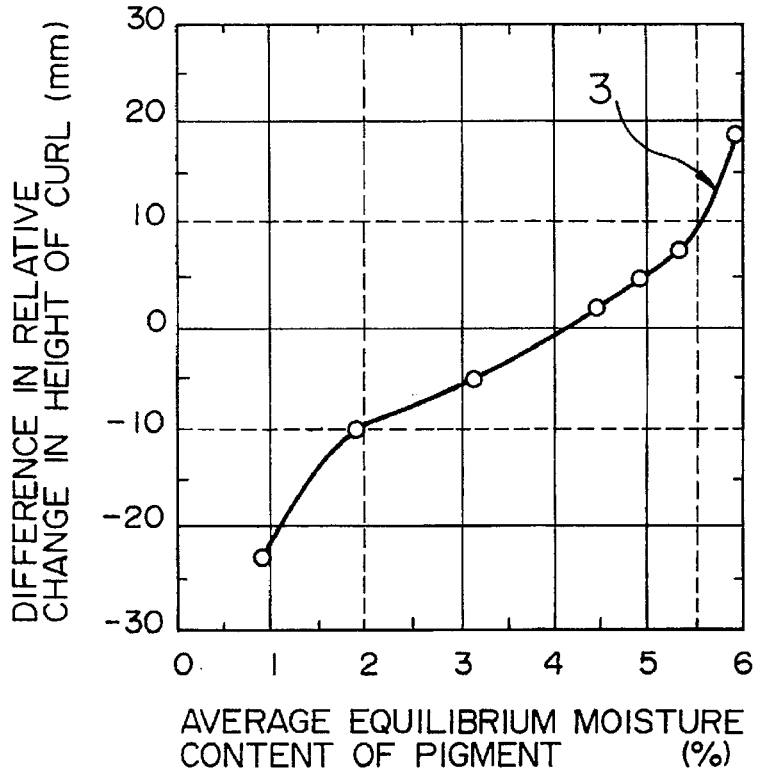
FIG. 2 is a graph which shows the relation between the average equilibrium moisture content of the pigment contained in the backcoat layer and the difference in the relative change in height of curl wherein curve 3 shows the difference ($H_H$–$H_L$) between the curve $H_H$ and the curve $H_L$.

The change of $H_H$, $H_L$ and $H_H$–$H_L$ with the average equilibrium moisture content of the pigments in Examples 16–22 is shown in FIG. 1 and FIG. 2.

As is clear from FIG. 1, when a pigment of high average equilibrium moisture content is added to the backcoat layer the ink jet recording sheet tends to curl towards the backcoat layer side under the conditions of low temperature and low humidity and the change of curl is relatively restrained under the conditions of high temperature and high humidity. On the other hand, it can be seen from FIG. 1 and FIG. 2 that when average equilibrium moisture content is in the range of 1.9–5.5% by weight, the change of curl due to change in atmospheric conditions is within the range acceptable.

EXAMPLES 23–28

Ink jet recording sheets were obtained in the same manner as in Example 16 except that amount (solid) of the styrene-butadiene latex in the backcoat layer was 2 parts, 5 parts, 30 parts, 60 parts or 70 parts in place of 15 parts as shown in Table 4.

Relative change in height of curls was measured in the above-mentioned manner. The results are shown in Table 4.

TABLE 4

| | Example 23 | Example 24 | Example 25 | Example 26 | Example 27 | Example 28 |
|---|---|---|---|---|---|---|
| [Support] | | | | | | |
| LBKP (part) | 80 | | | | | |
| NBKP (part) | 20 | | | | | |
| Pigment (part) | 25 | | | | | |
| Precipitated calcium carbonate (part) | 7.5 | | | | | |
| Ground calcium carbonate (part) | 8.75 | | | | | |
| Talc (part) | 8.75 | | | | | |
| Alkyl ketene dimer (part) | 0.10 | | | | | |
| Cationic acrylamide (part) | 0.03 | | | | | |
| Cationized starch (part) | 0.8 | | | | | |
| Aluminum sulfate (part) | 0.4 | | | | | |
| Basis weight (g/m$^2$) | 90 | | | | | |
| Ash content (%) | 17.9 | | | | | |
| [Ink-receiving layer] | | | | | | |
| Synthetic amorphous silica (part) | 100 | | | | | |
| PVA 117 (part) | 50 | | | | | |
| Cationic dye fixer (part) | 20 | | | | | |
| Solid concentration (%) | 13 | | | | | |
| Coating weight (g/m$^2$) | 10 | | | | | |
| Coating method | Airknife | | | | | |
| [Backcoat layer] | | | | | | |
| Hydrated halloysite KA (part) | 100 | | | | | |

TABLE 4-continued

| | Example 23 | Example 24 | Example 25 | Example 26 | Example 27 | Example 28 |
|---|---|---|---|---|---|---|
| Equilibrium moisture content of pigment (wt %) | 4.9 | | | | | |
| Sodium polyacrylate (part) | 0.4 | | | | | |
| Silanol group containing PVA (part) | 5 | | | | | |
| SBR latex 0693 (part) | 2 | 5 | 15 | 30 | 60 | 70 |
| Tg of latex (°C.) | +20 | | | | | |
| Solid concentration (%) | 35 | | | | | |
| Coating weight (g/m$^2$) | 8 | | | | | |
| Relative change in height of curl (mm) | | | | | | |
| HL | −5 | −5 | −4 | −1 | +1 | +2 |
| HH | +1 | +1 | +1 | −4 | −9 | −13 |
| HH-HL (mm) | +6 | +6 | +5 | −3 | −10 | −15 |
| Pick resistance of backcoat layer | C | B | A | A | A | A |
| Calendering linear pressure (kg/cm) | 200 | | | | | |

It can be seen from Table 4 that ink jet recording sheets excellent in curling resistance and pick resistance of the backcoat layer can be obtained when the weight ratio of pigment/binder in the backcoat layer is in the range of 100/5–100/60.

EXAMPLES 29–34COMPARATIVE EXAMPLE 7

Ink jet recording sheets were obtained in the same manner as in Example 16 except that the coating amount of the backcoat layer was changed as shown in Table 5.

TABLE 5

| | Comp. Example 7 | Example 29 | Example 30 | Example 31 | Example 32 | Example 33 | Example 34 |
|---|---|---|---|---|---|---|---|
| [Support] | | | | | | | |
| LBKP (part) | 80 | | | | | | |
| NBKP (part) | 20 | | | | | | |
| Pigment (part) | 25 | | | | | | |
| Precipitated calcium carbonate (part) | 7.5 | | | | | | |
| Ground calcium carbonate (part) | 8.75 | | | | | | |
| Talc (part) | 8.75 | | | | | | |
| Alkyl ketene dimer (part) | 0.10 | | | | | | |
| Cationic acrylamide (part) | 0.03 | | | | | | |
| Cationized starch (part) | 0.8 | | | | | | |
| Aluminum sulfate (part) | 0.4 | | | | | | |
| Basis weight (g/m$^2$) | 90 | | | | | | |
| Ash content (%) | 17.9 | | | | | | |
| [Ink-receiving layer] | | | | | | | |
| Synthetic amorphous silica (part) | 100 | | | | | | |
| PVA 117 (part) | 50 | | | | | | |
| Cationic dye fixer (part) | 20 | | | | | | |
| Solid concentration (%) | 13 | | | | | | |
| Coating weight (g/m$^2$) | 10 [WI] | | | | | | |
| Coating method | Airknife | | | | | | |
| [Backcoat layer] | | | | | | | |
| Hydrated halloysite KA (part) | 100 | | | | | | |
| Equilibrium moisture content of pigment | 4.9% by weight | | | | | | |
| Sodium polyacrylate (part) | 0.4 | | | | | | |
| Silanol group containing PVA (part) | 5 | | | | | | |
| SBR latex 0693 (part) | 15 | | | | | | |
| Tg of latex (°C.) | +20 | | | | | | |
| Solid concentration (%) | 35 | | | | | | |
| Coating weight (g/m$^2$) | 0 | 1 | 3 | 8 | 15 | 25 | 35 |
| WB-WI (g/m$^2$) | −10 | −9 | −7 | −2 | +5 | +15 | +25 |
| Relative change in height of curl (mm) | | | | | | | |
| HL | +42 | +20 | +8 | −4 | −6 | −9 | −9 |
| HH | Cylindrical | Cylindrical | +10 | +1 | +1 | +1 | +1 |
| HH-HL (mm) | +large | +large | +2 | +5 | +7 | +10 | +10 |
| Calendering linear pressure (kg/cm) | 200 | | | | | | |

It can be seen from Table 5 that ink jet recording sheets excellent in curling resistance can be obtained when the coating amount $W_B$ of the backcoat layer is 3 g/m$^2$ or more and the difference between the coating amount of the backcoat layer and that of the ink-receiving layer ($W_B$–$W_I$) is –10 to 25 g/m$^2$.

What is claimed is:

1. An ink jet recording sheet which comprises a support comprising a wood pulp and a pigment, an ink-receiving layer provided on one side of the support and a backcoat layer provided on the other side of the support, wherein the backcoat layer contains a binder comprising a synthetic polymer having a glass transition temperature of –50° to +25° C. and at least one water-soluble binder selected from the group consisting of starches, polyvinyl alcohols and cellulose derivatives.

2. An ink jet recording sheet according to claim 1, wherein the glass transition temperature of the synthetic polymer is –40° to +25° C.

3. An ink jet recording sheet according to claim 1, wherein the synthetic polymer is at least one polymer selected from homopolymers or copolymers of vinyl acetate, styrene, ethylene, vinyl chloride, acrylic acid, isobutylene, chloroprene, butadiene, acrylonitrile, methyl methacrylate esters, acrylate esters, and polymers obtained by modifying the above polymers with a carboxyl group.

4. An ink jet recording sheet according to claim 1, wherein a polyvinyl alcohol is the binder of the backcoat layer, said polyvinyl alcohol containing a silanol group.

5. An ink jet recording sheet according to claim 1, wherein the backcoat layer further contains a pigment having an average equilibrium moisture content M of 1.9–5.5% by weight calculated by the following formula (1):

$$M = \sum_{i=1}^{n} MiWi \tag{1}$$

wherein M denotes average equilibrium moisture content in percent by weight, i refers to a pigment, n is an integer greater than or equal to 1, and denotes the number of pigments contained, Mi denotes equilibrium moisture content of pigment i in percent by weight and Wi is greater than zero, equal to or less than 1, and denotes weight ratio of pigment i to the whole pigment.

6. An ink jet recording sheet according to claim 5, wherein the average equilibrium moisture content M of the pigment is 3.0–5.0% by weight.

7. An ink jet recording sheet according to claim 5, wherein the weight ratio of the pigment to the binder in the backcoat layer is between 100/5 to 100/60.

8. An ink jet recording sheet according to claim 1, wherein the coating amount $W_B$ of the backcoat layer is 3 g/m$^2$ or more and the difference $W_B$–$W_I$ from the coating amount $W_I$ of the ink-receiving layer is –10 to 25 g/m$^2$.

9. An ink jet recording sheet according to claim 1, wherein the ink-receiving layer contains at least one porous inorganic pigment selected from synthetic amorphous silica, magnesium carbonate and alumina hydrate.

* * * * *